US006575599B1

(12) United States Patent
Imamura et al.

(10) Patent No.: US 6,575,599 B1
(45) Date of Patent: Jun. 10, 2003

(54) LIGHT SOURCE DEVICE FOR PROJECTION APPARATUS

(75) Inventors: Kenji Imamura, Himeji (JP); Tetsu Takemura, Himeji (JP); Hiroyuki Fujii, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/385,571

(22) Filed: Aug. 30, 1999

(30) Foreign Application Priority Data

Sep. 8, 1998 (JP) ..... 10-269046

(51) Int. Cl.[7] ..... F21V 29/00

(52) U.S. Cl. ..... 362/294; 362/264; 362/373; 362/345; 313/113

(58) Field of Search ..... 362/294, 264, 362/373, 345, 263; 313/20, 22, 24, 44, 113

(56) References Cited

U.S. PATENT DOCUMENTS 3,120,928 A * 2/1964 Gotze ..... 362/294
3,180,981 A * 4/1965 Ulffers ..... 362/294
3,843,879 A 10/1974 Eddy
4,149,086 A * 4/1979 Nath ..... 250/504
4,423,348 A * 12/1983 Greiler ..... 313/113
4,630,182 A 12/1986 Moroi et al.
5,205,642 A * 4/1993 Kai et al. ..... 362/341
5,207,505 A * 5/1993 Naraki et al. ..... 362/373
5,614,780 A * 3/1997 Suzuki et al. ..... 313/35
5,806,971 A * 9/1998 Sugihara et al. ..... 362/264
5,860,719 A * 1/1999 Suzuki et al. ..... 353/52
5,906,429 A * 5/1999 Mori et al. ..... 250/492.2
5,957,570 A * 9/1999 Ooyama et al. ..... 362/263
5,998,934 A * 12/1999 Mimasu et al. ..... 315/118

FOREIGN PATENT DOCUMENTS

JP 5-251054 9/1993
WO WO 96/15455 5/1996

* cited by examiner

*Primary Examiner*—Sandra O'Shea
*Assistant Examiner*—James W Cranson
(74) *Attorney, Agent, or Firm*—Nixon Peabody LLP; David S. Safran

(57) ABSTRACT

In a light source unit which has a discharge lamp which is located in a differential pressure passage system, an arrangement in which the discharge lamp and a concave reflector can be cooled with high efficiency is achieved by a discharge lamp being attached in the neck of a concave reflector which is located essentially horizontally, and at the same time, in the differential pressure passage system. Furthermore, at least one cooling air discharge opening is located in the neck area of the concave reflector; translucent glass covers the front opening of the concave reflector; and at least one cooling air injection opening is located in the area of the front opening of the concave reflector and has directional accuracy with reference to the inside of the concave reflector.

14 Claims, 7 Drawing Sheets

LIGHT SOURCE DEVICE FOR PROJECTION APPARATUS

BACKGROUND OF THE INVENTION

1. Field of the Invention

The invention relates to a light source device, and especially to a light source device which is used for a projection device, such as a liquid crystal projector or the like.

2. Description of the Related Art

In a light source device which is used for a liquid crystal projector or the like, the light source is a discharge lamp, such as a metal halide lamp or super high pressure mercury lamp. The light radiated from this discharge lamp is focused by a concave reflector, and furthermore, by means of an optical lens, such as an integrator lens or the like, is emitted onto a liquid crystal surface, such that the illuminance on the screen becomes uniform.

There are, for example, discharge lamps of the short arc type as the light source, which during operation, reach a high operating pressure of roughly 20 to 150 atm in the arc tube. In this case, there can also be cases in which, within the conventionally required lamp service life, deterioration of the arc tube or fracture of the discharge lamp occurs. When the discharge lamp fractures, fragments with a high temperature spray in the optical system, in the power source and the like within the projector. These glass splinters adversely affect and foul the above described components. This is disclosed, for example, in published Japanese Patent Application HEI 5-251054. In this case, the repair is complex and great fracture noise may arise.

Known measures against this include a process in which the front opening of the concave reflector is covered with translucent glass, preventing the splinters from spraying to the outside, even if the discharge lamp fractures during operation in the exceptional case. Furthermore, damping the fracture noise by covering with translucent glass and prevention of major fracture noise are also known.

Covering the front opening of the concave reflector with translucent glass is indeed effective for preventing lamp fracture and for noise attenuation. But since the inside of the concave reflector is located essentially in a hermetic state, the inside of the reflector reaches an extremely high temperature during operation. Specifically, the emission part and the hermetically sealed portions of the discharge lamp reach an overly high temperature; this leads to devitrification in the arc tube and formation of cracks in the metal foils in the hermetically sealed portions as a result of oxidation and expansion.

Furthermore, there are cases in which the heat resistance temperature of the film formed by vacuum evaporation is exceeded or in which, between the inside and the outside of the reflector, a large temperature difference occurs when the mirror surface temperature of the reflector becomes unduly high. In these cases, thermal deterioration of the vacuum evaporated film, such as cracks and the like, and large cracks in the reflector due to heat can occur.

SUMMARY OF THE INVENTION

Therefore, a primary object of the present invention is to devise an arrangement in which a discharge lamp within a concave reflector and the mirror surface of the reflector can be advantageously cooled, the front opening of the reflector being covered with translucent glass, and the reflector surrounding the discharge lamp.

In a light source device, in which a discharge lamp is attached in the neck of a concave reflector, and which is located in a differential pressure passage system, the above object is achieved in accordance with the invention by the following features.

- at least one cooling air discharge opening is located in the neck area of the concave reflector;
- translucent glass covers the front opening of the concave reflector; and
- at least one cooling air injection opening is located in the area of the front opening of the concave reflector and has directional accuracy with reference to the inside of the concave reflector.

Furthermore, the object is advantageously achieved according to the invention in that the above described air injection opening has a discharge direction which is aligned relative to the hermetically sealed portion on the side of the front opening of the discharge lamp.

Moreover, the object is advantageously achieved in accordance with the invention in that the above described air injection opening has a discharge direction which is aligned such that some of the mirror surface of the concave reflector is directly impacted.

The object is also advantageously achieved in accordance with the invention in that several air injection openings are formed, that at least one of them has a discharge direction which is aligned relative to the hermetically sealed portion on the side of the front opening of the discharge lamp, and that at least one of the remaining air injection openings is aligned such that some of the mirror surface of the concave reflector is directly impacted.

The object is, furthermore, advantageously achieved in accordance with the invention in that some of the peripheral edge of the front opening of the concave reflector is provided with a gap which is provided with an air injection opening.

Additionally, the object is advantageously achieved in accordance with the invention in that the above described air discharge opening and/or the air injection opening is provided with a sound attenuation tube.

Still further, the object is advantageously achieved in accordance with the invention in that in the neck of the concave reflector a sleeve is attached in which a ventilation path is formed which consists of a series of narrow spaces.

The object is also advantageously achieved in accordance with the invention in that the front opening of the concave reflector has a maximum opening diameter of at most 80 mm.

The object is, furthermore, advantageously achieved in that the discharge lamp is operated with a nominal wattage of at least 130 W.

In the following, the invention is described using several embodiments shown in the drawings.

BRIEF DESCRIPTION OF THE DRAWINGS

FIG. 8(*b*) is a schematic front view of the embodiment as shown in FIG. 8(*a*);

FIG. 9(*b*) shows a schematic front view of the embodiment as shown in FIG. 9(*a*);

FIG. 10(*c*) shows a schematic front view of the embodiment as shown in FIG. 10(*a*)

DETAILED DESCRIPTION OF THE INVENTION

Figure 1A:
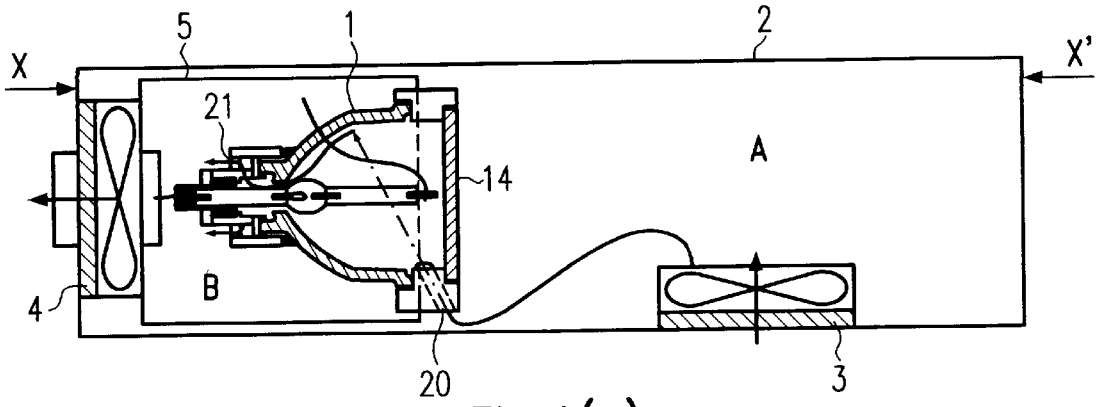
FIGS. 1(*a*) & 1(*b*) are schematic cross-sectional views taken at right angles to each other, each view showing a light source unit in accordance with the invention.
Figure 1B:
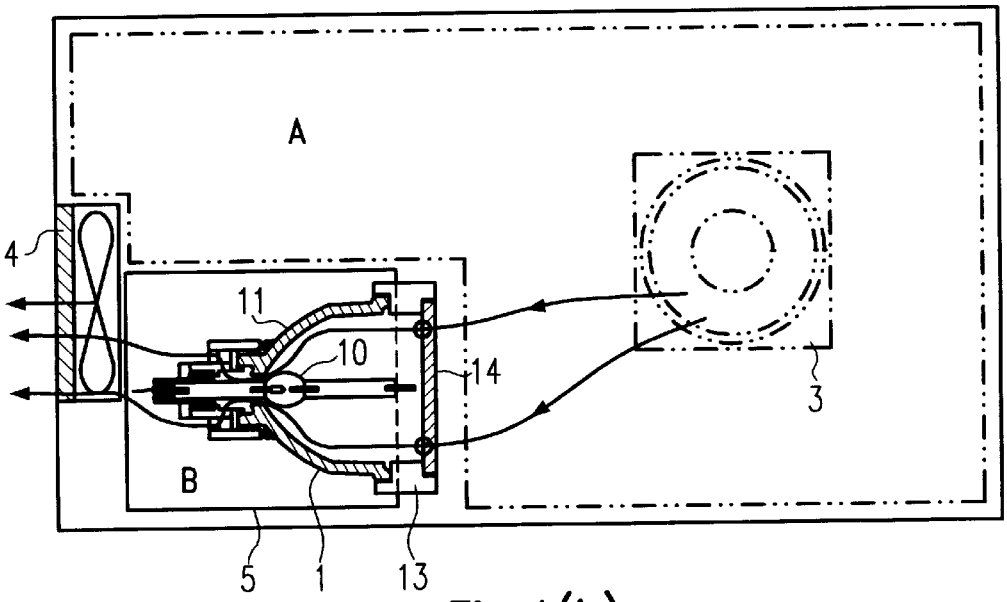

FIG. 1(*a*) and 1(*b*) each show a light source unit 1 in accordance with the invention which is located in an outer housing 2 which forms a differential pressure path, FIG. 1(*a*) showing the outer housing 2 in vertical cross section and FIG. 1(*b*) showing an overhead cross-sectional view looking downward from line X—X' in FIG. 1(*a*). For the outer housing 2, in practice, a liquid crystal projector means or the like is used. Within the outer housing 2, there are different parts besides the light source unit, but since all such parts are conventional and do not play a role in the features of the invention, they have been omitted for clarity and simplicity of illustration.

One wall of the outer housing 2 (in the drawing, the bottom wall) is provided with a suction (intake) fan 3, while another wall of the outer housing 2 (in the drawing, a side wall) is provided with an evacuation (exhaust) fan 4. The intake fan 3 and the exhaust fan 4 are, for example, propeller fans and can cool not only the light source unit 1, but also the various other parts which are located in the outer housing 2.

Figure 2:
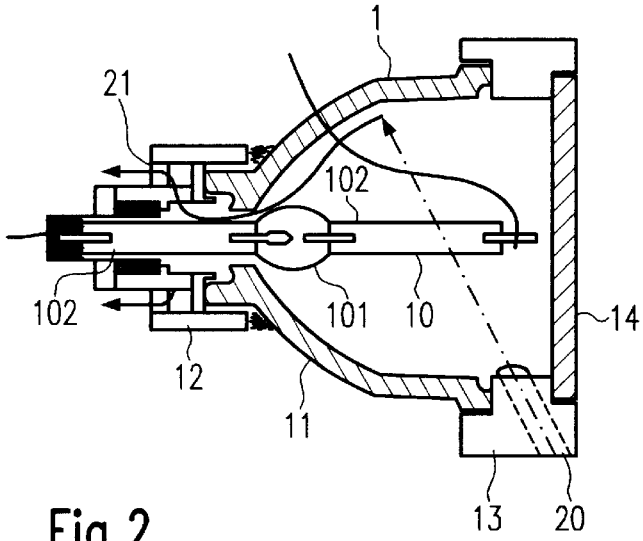
FIG. 2 is a schematic cross section of a discharge lamp in accordance with the invention with a reflector.

FIG. 2 schematically shows the light source unit 1. In the figure, a discharge lamp 10 is arranged essentially horizontally in a concave reflector 11 (hereinafter, also called solely a "reflector") such that the optical axis of the reflector 11 and the longitudinal axis of the discharge lamp 10 coincide with each other. In the neck of the reflector 11, a lamp holding component 12 is installed in which the discharge lamp 10 is attached.

In the front opening of the reflector 11, there is a translucent glass 14 mounted over an installation component 13. By means of this arrangement, the light source unit 1 is essentially in a hermetically sealed state, aside from a cooling opening which is described below. In this way, the problem of spraying of splinters can be advantageously eliminated, even if the discharge lamp 10 fractures.

The discharge lamp 10 is made of fused silica glass and is, e.g., a 150 W mercury lamp of the short arc type. In its emission part 101, the lamp has a pair of electrodes. Opposite ends of the emission part 101 are each provided with a hermetically sealed portion 102 in which there is a metal foil. One electrode is connected to an end of each metal foil, while an outer lead is connected to the other end of the metal foil. For the discharge lamp 10, for example, a small lamp is used with a distance between the electrodes of 1.4 mm and a maximum diameter of the emission part 101 of roughly 11 mm.

When the discharge lamp 10 reaches an overly high temperature during operation, devitrification of the fused silica glass of the emission part occurs. Therefore, it is necessary to advantageously cool the emission part during lamp operation, especially the upper part. In the hermetically sealed portions, a metal foil is installed and these parts are oxidized when the temperature rises too high.

The concave reflector 11 is used for advantageous emission of the light emitted from the discharge lamp 10 from the front side of the light source unit 1. In the reflector 11, a reflection film is applied to a material, such as borosilicate glass or the like. The material of the reflector 11 is of course not limited to borosilicate glass. In the case of a relatively low rated power consumption of the discharge lamp, however, borosilicate glass is often used. In this case, a borosilicate glass is used which has a coefficient of thermal expansion of roughly 32 to $38\times10^{-7}$/° C., with a maximum operating temperature of 460 to 490° C., and with a normal operating temperature of 230° C., and in which, at a thickness of 3.3 mm, there is resistance to thermal loading up to a temperature difference of 160° C.

For the material of the reflector 11, a crystal glass is also used which has better heat resistance and a better coefficient of thermal expansion than the above described borosilicate glass. It has, for example, a coefficient of thermal expansion of $4.1\times10^{-7}$/° C., a maximum operating temperature of 600° C. and a normal operating temperature of 500° C., and at a thickness of 3.3 mm, there is resistance to thermal loading up to a temperature difference of roughly 400° C.

A multilayer film formed by vacuum evaporation of silicon dioxide ($SiO_2$) and titanium dioxide ($TiO_2$) is applied to the mirror surface of the reflector 11. In this case, the heat resistance temperature is roughly 450° C.

The translucent glass 14 is installed in the front opening of the reflector 11 over the installation component 13 by means of an adhesive or the like; generally borosilicate glass is used for it. For installation of the translucent glass 14 with consideration of a case of fracture of the arc tube, a stop or similar methods can be used, so that the glass does not fall out due to the instantaneous force when the arc tube fractures. Furthermore, the translucent glass 14 together with the reflector 11 can be arranged as an integrator lens. In this case, the reflector 11 and the translucent glass 14 are each divided into the same number of areas, the respective areas corresponding to one another 1:1. With this execution of the integrator lens by the reflector and the translucent glass, uniform light radiation with a compact arrangement can be achieved. With respect to this technology reference is made to the older published application of the assignee of the present application, Japanese Patent Application HEI 9-185008 and corresponding European Patent Application 0783116 A1.

The installation part 13 is provided with air injection openings 20 through which cooling air flows in from the outside. Furthermore, a sleeve 12, which is connected to the neck of the reflector 11, is provided with air discharge openings 21 through which cooling air is discharged. The air injection openings 20 have directional accuracy with respect to a certain area so that the inside of the light source unit 1 is advantageously cooled. The certain area in this case differs depending on the nominal wattage of the discharge lamp, the size of the emission part, the size of the hermetically sealed portions, the size of the interior of the reflector, the presence or absence of a metal foil in the respective hermetically sealed portion from the light source unit to the light source unit. This means that the area which the cooling air flowing into the light source unit first directly hits may change. Although the inside of the light source unit is an essentially hermetic space, the discharge lamp, the reflector and the like can each be effectively cooled by their being exposed to cooling air or by the cooling air being circulated. The discharge direction of the air injection openings is aligned in FIG. 2 such that some of the mirror surface of the concave reflector 11 is directly impacted.

In FIGS. 1(*a*) & 1(*b*), in the outer housing 2, a partition 5 is formed such that the light source unit 1 is enclosed. The inside of the outer housing 2 is separated into a space A which comprises the intake fan 3 and the air injection openings 20 of the light source unit 1, and into a space B which comprises the exhaust fan 4 and the air discharge openings 21 of the light source unit 1, the partition 5 acting as a boundary.

In this arrangement the flow of cooling air is described as follows:

The cooling air flowing into the interior of the outer housing 2 from the intake fan 3 flows into the interior of the light source unit 1 due to the pressure difference between the space A and the space B. In this case, the air flows in through the air injection openings 20 of the installation component 13. The air injection openings 20 have a certain directional accuracy so that a passage is formed through which the interior of the light source unit 1 can be advantageously cooled, as was described above. The cooling air flowing out of the air discharge openings 21 of the light source unit 1 is discharged to the outside from the outer housing 2 by the exhaust fan 4.

Such effective cooling can only be achieved by the feature in accordance with the invention that the light source unit 1 is located in a differential pressure path. This means that the pressure in the light source unit and its immediate vicinity is different than in the area farther away from the light source unit and there is a pressure gradient between the two areas; this leads to the desired flow conditions. Furthermore, the arrangement of the translucent glass in the front opening of the concave reflector 11 is an important feature with respect to use of the differential pressure path. The amount of cooling air which flows due to this differential pressure changes depending on the diameter and the arrangement of the at least one air injection opening, the diameter and the arrangement of the at least one air discharge opening and the like.

Figure 3:
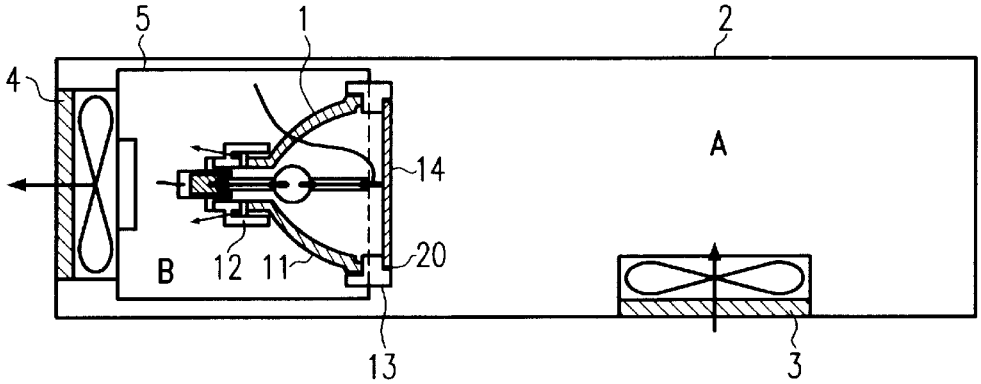
FIGS. 3 is a view corresponding to that of FIG. 1(*a*), but showing a schematic cross section of another embodiment of the light source unit in accordance with the invention.
Figure 4:
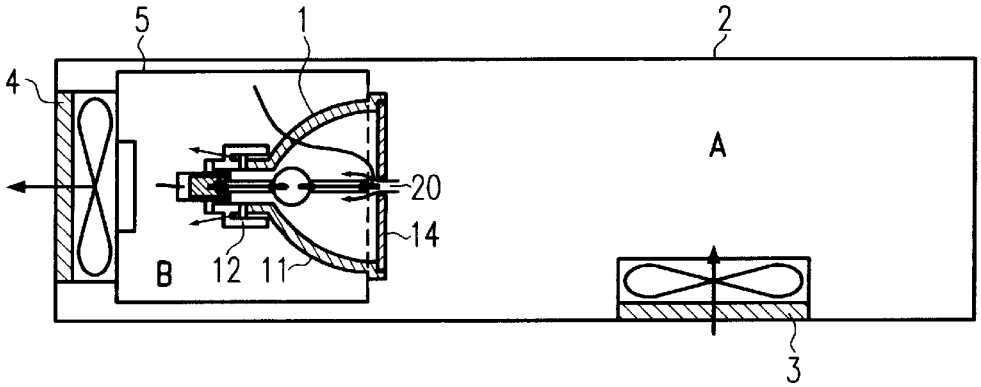
FIG. 4 is a view corresponding to that of FIG. 1(*a*), but showing a schematic cross section of a further embodiment of the light source unit in accordance with the invention.
Figure 5A:
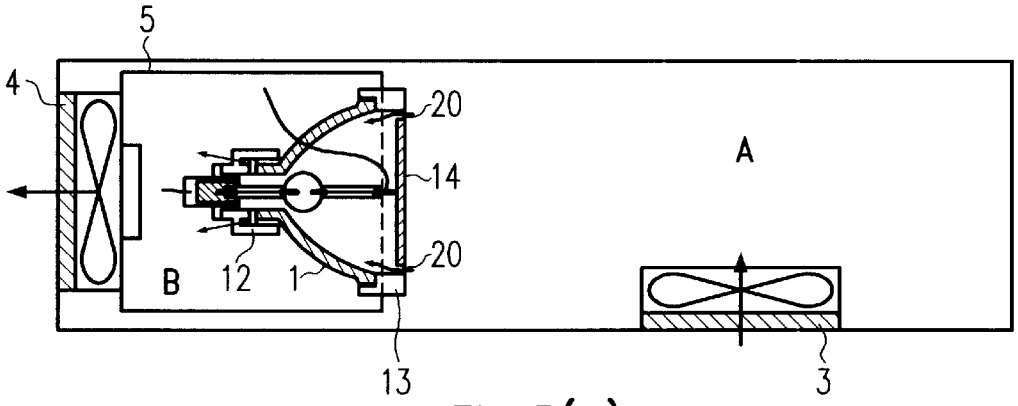
FIGS. 5(*a*) & 5(*b*) are views corresponding to that of FIG. 1(*a*), but showing a schematic cross section of fourth embodiment of the light source unit in accordance with the invention and a variant thereof, respectively.
Figure 5B:
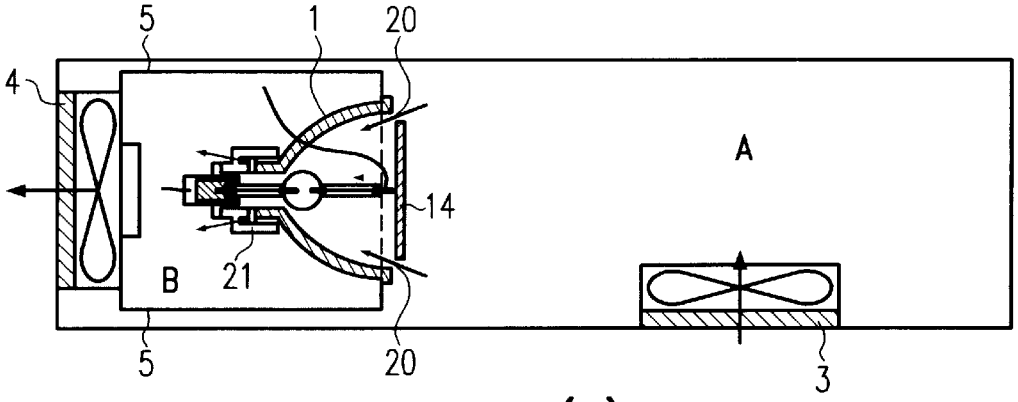

FIGS. 3–5 schematically show other embodiments. The difference from the embodiment shown in FIG. 1 lies in that the positions of the air injection openings located in the light source unit 1 are different. Specifically, in FIG. 3 the air injection openings are not located in the installation component 13, but are located between the installation component 13 and the translucent glass 14 at distance from one another. The distance is, for example, 4.5 mm.

In FIG. 4 the middle area of the translucent glass 14 is provided with an opening. The cooling air flows along the axis of the hermetically sealed portions of the discharge lamp 10. The opening made in the glass 14 has a diameter of, for example, 8.5 mm.

In FIG. 5(*a*), between the installation component 13 and the glass 14, there are openings, the openings being located not only in the bottom area, but also in the upper area. In FIG. 5(*b*) there is no installation component 13. Here the translucent glass 14 is installed directly with a distance to the reflector 11.

In these embodiments as well, the partition 5 in the outer housing 2 separates the space A which comprises the intake fan 3 and the air injection openings 20 of the light source unit 1, from the space B which comprises the exhaust fan 4 and the air discharge openings 21 of the light source unit 1 from one another.

The cooling air flowing into the interior of the outer housing 2 from the intake fan 3 flows into the interior of the light source unit 1 due to the pressure difference between the space A and the space B. The cooling air flowing out of the air discharge openings 21 is discharged to the outside by the exhaust fan 4 from the outer housing 2.

This flow of cooling air can be achieved only by the feature in accordance with the invention that the light source unit 1 is located in a differential pressure path, as was also the case in the above described example. Furthermore, the arrangement of the translucent glass in the front opening of the concave reflector 11 is an important feature with respect to use of the differential pressure path.

Figure 6A:
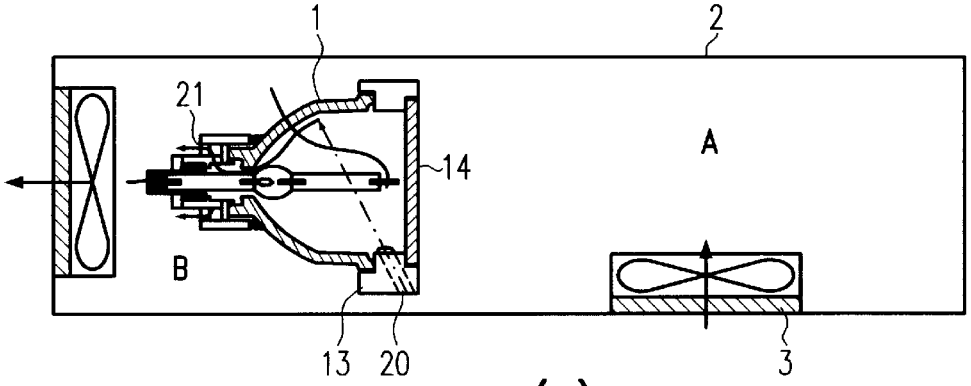
FIG. 6(*a*) & 6(*b*) are views corresponding to those of FIG. 1(*a*) & 1(*b*), but showing a schematic cross section of a fifth embodiment of the light source unit in accordance with the invention.
Figure 6B:
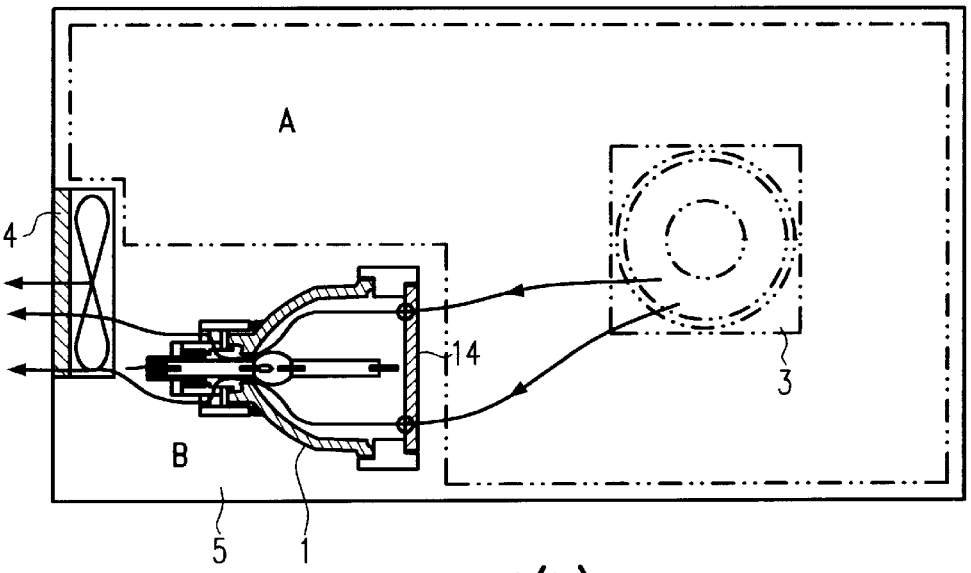

FIG. 6 shows another embodiment of the outer housing 2 which comprises the light source unit 1. This embodiment differs from the above described embodiments in that no clear separation is made between space A, which contains the intake fan 3 and the air injection openings 20 of the light source unit 1, and space B which contains the exhaust fan 4 and the air discharge openings 21 of the light source unit 1, and in that there is no partition 5. However, here, as shown in the drawings, a differential pressure path is formed within the outer housing 2 by the distance between the installation components 13 and the inside wall of the outer housing 2 of the light source unit 1 being small. The cooling air flowing in through the intake fan 3 flows into the light source unit 1 due to this differential pressure. In this way, the discharge lamp and the mirror surface of the reflector can be advantageously cooled.

In the following, experiments are described which show the action of the light source unit in accordance with the invention.

Figure 7:
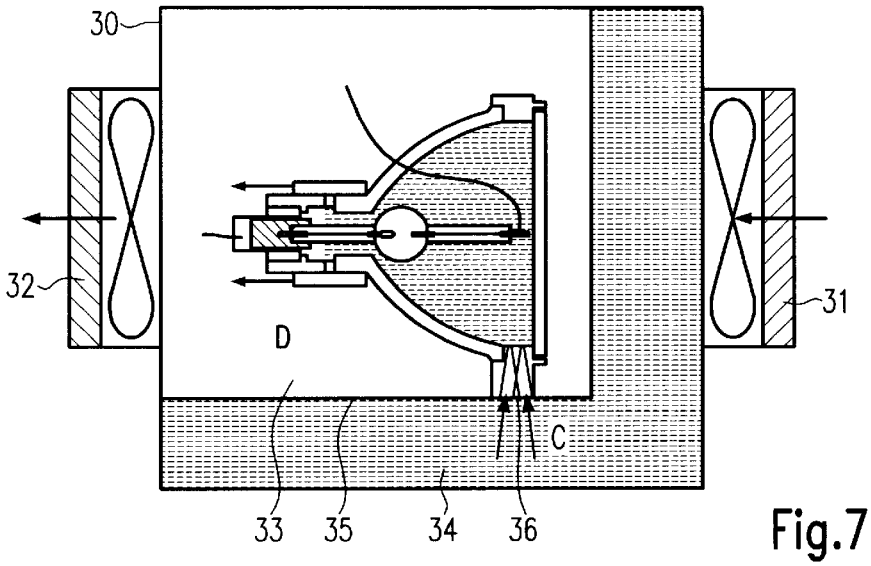
FIG. 7 is a schematic cross section of a test means showing the action of the invention.

The experiments were performed using the, then, experimental box 30 shown in FIG. 7. In the drawings, the experimental box 30 is separated into a chamber C and a chamber D by a partition 35. In the chamber C, a intake fan 31 is installed which blows cooling air into the experimental box 30. An exhaust fan 32 which discharges the cooling air from the box to the outside is installed in the chamber D. The chamber C forms a space 34, while the chamber D forms a space 33. The spaces 33 and 34 are separated roughly such that a differential pressure value is obtained. Furthermore, the partition 35 is provided with openings 36 through which cooling air flows. The wall of the chamber C is provided with an opening. Due to this arrangement the chamber C has a higher pressure than the chamber D. This pressure difference yields a flow of cooling air which cools the interior of the light source unit.

The lamp has a nominal power consumption of 150 W and is operated using a direct current. A super high pressure mercury lamp was used with a mercury operating pressure during operation which was greater than or equal to 120 atm. For the intake fan and the exhaust fan a 12 V propeller fan was used. Openings 36 were made at two points in the direction to the mirror surface of the reflector and at another two points in the direction to the hermetically sealed portions of the discharge lamp, therefore at four points in all. Each opening has a diameter of 4.5 mm.

In this experimental means, the differential pressure was changed by changing the distance of the gap which forms by opening and closing the passages which were located in the chamber C and the chamber D (not shown in the drawings). Specifically, the differential pressure was 22 Pa and the amount of air was 8.8 (1/min) in test 1, 11 Pa and 6.2 (1/min) in test 2, 9 Pa and 5.4 (1/min) in test 3 and 0 Pa and accordingly 0.0 (1/min) in test 4.

The temperatures of the emission part of the discharge lamp at the respective differential pressure (temperature of the upper area and of the lower area of the emission part), the temperature of the hermetically sealed portions, the temperature of the inside of the reflector and the temperature difference between the inside and the outside of the reflector were measured.

The temperatures were measured by each measuring point being provided with a thermocouple. Measurement of the differential pressure was performed by installing a pressure sensor tube in the chamber C and in the chamber D.

The temperature of each area was measured 20 minutes after the start of operation. The measurement results are shown below. Here "threshold values" are defined as numerical values above which defects arise. The temperature of the lower area of the arc tube is the minimum required temperature for obtaining the vapor pressure of the filled mercury. In this lamp is it roughly 730° C.

TABLE 1

| A | B | C | D | E | F | G |
|---|---|---|---|---|---|---|
| 1 | 22 | 834 | 813 | 179 | 364 | 129 |
| 2 | 11 | 921 | 853 | 222 | 417 | 148 |
| 3 | 09 | 938 | 863 | 236 | 433 | 150 |
| 4 | 0 | 1030 | 914 | 431 | 570 | 185 |
| | Threshold value | 940 | | 350 | 460 | 150 |

A - Experiment number
B - Differential pressure (Pa)
C - Temperature of the upper area of the arc tube
D - Temperature of the lower area of the arc tube
E - Temperature of the hermetically sealed portions
F - Temperature of the inside of the reflector
G - Temperature difference between the inside and the outside of the reflector The unit of temperature is always ° C.

With respect to the amount of air flowing due to the differential pressure, all these experiments were run under the same conditions of the arrangement of the air injection openings and the like and of the intake fan, the exhaust fan, and the like, except for the fact that the differential pressure was changed by the opening and closing angle of the passages. The amount of air was measured using an air quantity measurement device.

It is apparent from the test results that in all methods (experiments 1, 2 and 3) in which differential pressure was used to produce cooling air flows into the light source unit, the temperature of the respective part was less than or equal to the threshold value. Conversely, in the methods in which differential pressure was not used and the amount of air is 0, the temperatures of the arc tube, the hermetically sealed portions and the reflector were above the threshold value, and it is apparent that advantageous cooling did not result.

Figure 8A:
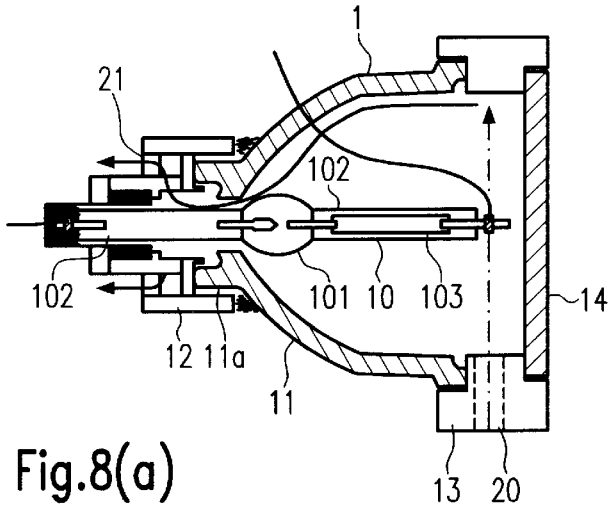
FIG. 8(*a*) is a schematic cross section of another embodiment of the invention.
Figure 8B:
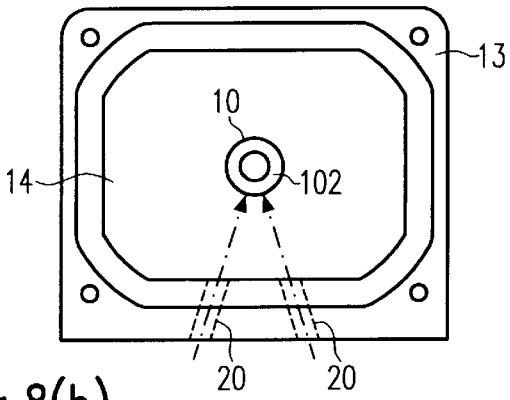

FIGS. 8(*a*) & 8(*b*) schematically show an embodiment of a light source unit which is integrated into the light source device in accordance with the invention. It has an arrangement which differs from the light source unit shown in FIG. 2.

The discharge lamp 10 is inserted into the neck 11*a* of the concave reflector 11 and is attached by the holding component 12 or the like by means of an adhesive or the like such that the optical axis of the reflector 11 and the longitudinal axis of the lamp 10 agree with one another. In the front opening of the reflector 11, the translucent glass 14 is installed by the installation component 13. The lower half of the installation component 13 is provided with air injection openings 20 for the cooling air. In this embodiment, there are two air injection openings (see FIG. 8*b*). The neck area of the reflector 11 is provided with air discharge openings 21 for the cooling air.

In this embodiment, the cooling air enters through the air injection openings 20 and flows in the light source unit 1 in a direction toward the end of the hermetically sealed portion 102 on the side of the front opening of the discharge lamp (the part connected to the outer lead). In the drawing, the flow of this cooling air is shown using an arrow. Afterwards, the cooling air enters the upper area of the installation component 13 or a part of the mirror surface of the concave reflector 11, is incident along the reflector 11 and cools the upper area of the arc tube of the discharge lamp. Afterwards it is discharged to the outside from the unit by the air discharge openings 21 which are located in the neck area of the reflector 11.

The distinction of this embodiment lies in that the discharge direction of the air injection openings 20 is aligned in a direction toward the end of the hermetically sealed portion 102 on the side of the front opening of the discharge lamp 10. This arrangement directly exposes the end of the hermetically sealed portion 102 to cooling air on the side facing the front opening of the discharge lamp. In this way, this area can be effectively cooled, and at the same time, the areas with a high temperature within the optical unit can be effectively cooled by the subsequent flow of the cooling air in the optical unit.

In FIGS. 8(*a*) & 8(*b*), the cooling air enters through the air injection openings 20, and in the light source unit 1, directly impacts the end of the hermetically sealed portion 102 on the side directed toward the front opening of the discharge lamp. However, the air injection openings can also be arranged such that the cooling air directly impacts that area of the hermetically sealed portion 102 in which the metal foil 103 is installed.

Figure 9A:
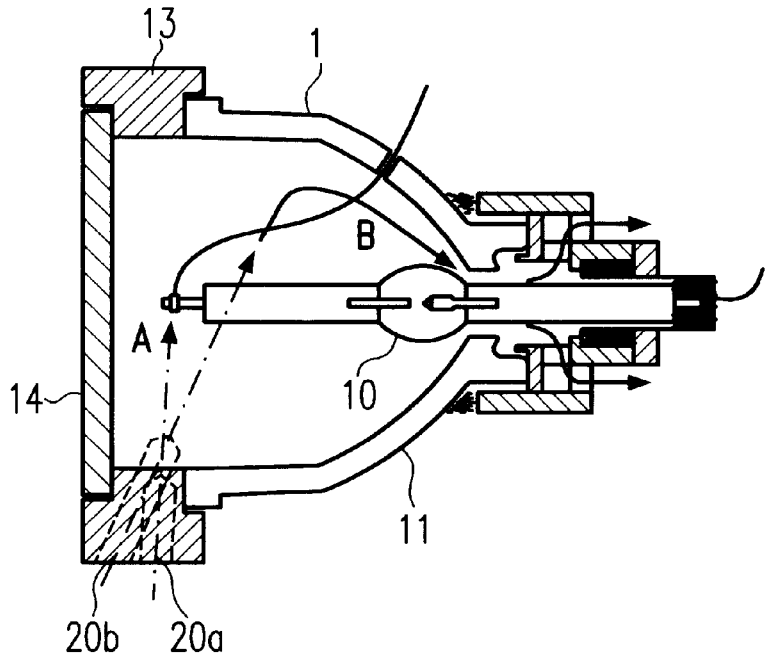
FIG. 9(*a*) shows a schematic cross section of another embodiment of the invention.
Figure 9B:
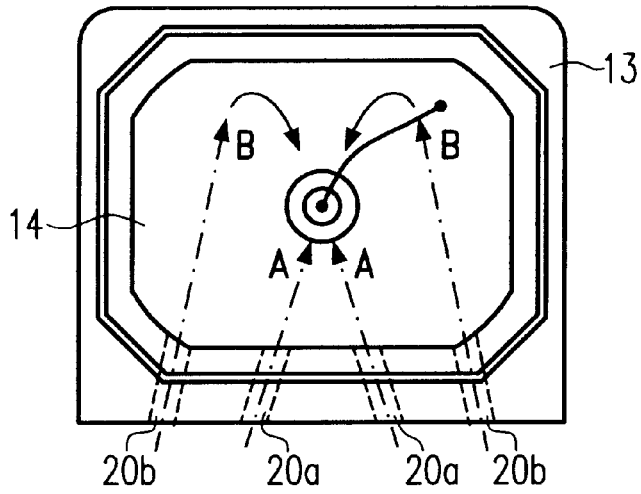

FIGS. 9(*a*) & 9(*b*) show another embodiment of the light source unit which is integrated into the light source device in accordance with the invention. The front opening of the concave reflector 11 is provided with the installation component 13 in which several air injection openings 20*a*, 20*b* for cooling air are formed.

In this embodiment, the cooling air enters the light source unit 1 from the respective air injection openings 20*a*, 20*b*. The cooling air which has passed through at least one of the air injection openings 20*a* directly impacts the end of the hermetically sealed portion 102 on the end facing the front opening of the discharge lamp. The cooling air which has passed through one of the other air injection openings 20*b* directly impacts some of the mirror surface of the concave reflector 11. The flow of this cooling air is shown in FIGS. 9(*a*) and 9(*b*) using the arrows A and B.

In this embodiment, therefore, there are several types of air injection openings 20*a*, 20*b*. One type of these openings, i.e., 20*a*, has a discharge direction which is aligned such that the cooling air directly strikes the hermetically sealed portion on the end directed toward the front opening of the discharge lamp 1. The other type of air injection openings

20*b* is characterized in that they are aligned such that the cooling air directly strikes part of the mirror surface of the concave reflector. This arrangement can effectively cool the hermetically sealed portion on the end directed toward the front opening of the discharge lamp and the area of the mirror surface of the concave reflector which reaches an especially high temperature. Furthermore, by means of the subsequent air flow, the emission part and the like of the discharge lamp can also be advantageously cooled.

Figure 10A:
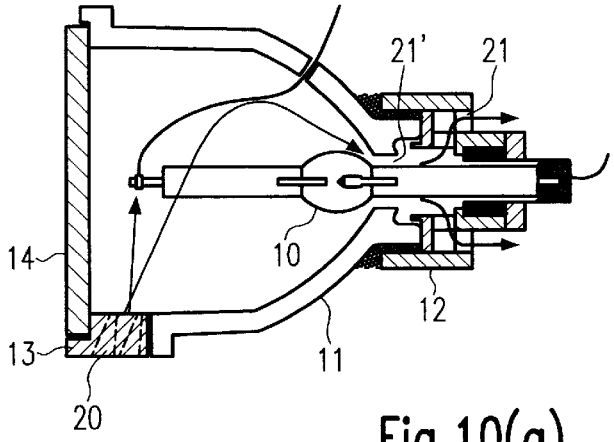
FIGS. 10(*a*) & 10(*b*) each show a schematic cross section of another embodiment of the invention.
Figure 10B:
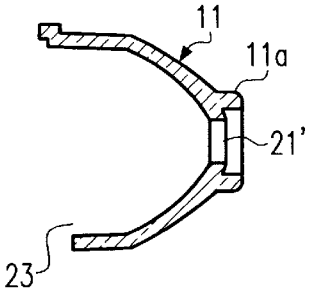
Figure 10C:
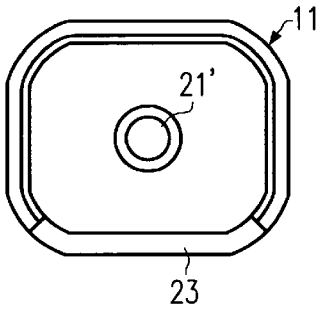

FIGS. 10(*a*), (*b*) and (*c*) schematically show another embodiment of the light source unit which is integrated into the light source device in accordance with the invention. In FIG. 10(*a*) the lamp is combined with the reflector. FIG. 10(*b*) shows only the reflector in cross section. FIG. 10(*c*) shows only the reflector in a front view. In a part (on the bottom) of the peripheral edge of the front opening of the concave reflector 11, a gap 23 is formed in which air injection openings of the installation component 13 for the cooling air are positioned. In the figures, the reflector 11 has a neck 11*a*, an opening 21' of the reflector on the side of the neck and a gap 23. The length of the light source unit in the direction of the optical axis can be reduced by this arrangement.

Figure 11:
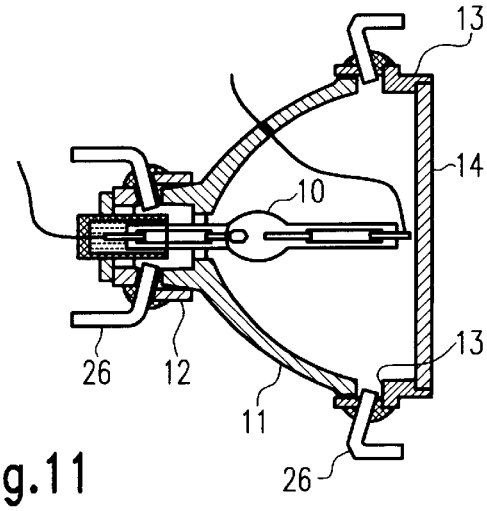
FIG. 11 is a schematic cross section of yet another embodiment of the invention.

FIG. 11 shows a light source unit in which the air injection openings 20 and air discharge openings 21 for the cooling air are each provided with a tube 26. This arrangement can reduce the fracture noise which penetrates to the outside when the discharge lamp breaks during operation of the light source unit. This prevents individuals in the vicinity from feeling unpleasant or unsafe. The noise attenuation tube can be located either in the air injection opening and or in the air discharge opening.

Furthermore, instead of the arrangement of the tube in the sleeve 12 as shown in FIG. 10(*a*), an outlet for blowing out air can be formed and a series of these passages arranged. In this case, the area for blowing out the air can be easily formed, especially by placing the air passages in the sleeve.

The light source device in accordance with the invention is especially suitable for effective cooling in cases in which the temperature of the respective part becomes high, for example, when a discharge lamp with a nominal wattage equal to at least 130 W is operated and the discharge lamp has a small shape, i.e., the maximum opening diameter of the front opening of the concave reflector is no greater than 80 mm.

The above described embodiments were all described using a lamp of the horizontal type. In the case of a lamp of the suspended type, in which the lamp hangs down from the ceiling, a lamp is generally used in which the top and bottom are reversed. In this case, if a lamp of the horizontal type were used as the lamp of the suspended type, the lower area of the light source unit is overcooled, while the top is not adequately cooled. If therefore a lamp of the horizontal type is to work as a lamp of the suspended type, it is preferred that basically the same cooling arrangement be provided both in the upper and also in the lower area of the lamp. But, the air injection openings can also be opened and closed by switching. Moreover, it is possible to reverse the air flow and for the air to enter the light source unit through the air discharge openings in the neck area and emerge through the injection openings. In this way, the cooling air first strikes the especially hot upper area of a lamp of the suspended type and cools it especially effectively.

Action of the Invention

As was described above, the light source unit in accordance with the invention has the following arrangement:

a discharge lamp is attached in the neck of a concave reflector the light source unit is located in the differential pressure passage system at least one air discharge opening for cooling air is located in the neck of the reflector the front opening of the reflector is covered by translucent glass in the area of the front opening of the reflector there is at least one cooling air injection opening which has directional accuracy with respect to the inside of the reflector.

This arrangement makes it possible to advantageously cool the emission part and the hermetically sealed portions of the discharge lamp and the entire mirror surface of the reflector. Furthermore, an advantageous measure can be taken against fracture of the discharge lamp by the translucent glass.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

What we claim is:

1. Light source device in which a discharge lamp is attached in the neck of a concave reflector and is located in a differential pressure passage system, comprising:

at least one cooling air discharge opening which is located in a neck area of the concave reflector;

a translucent glass which closes a front opening of the concave reflector; and at least one cooling air intake opening which is located rearward of the translucent glass in an area of the closed front opening of the concave reflector and with reference to the inside of the concave reflector has selected directional accuracy;

wherein a cooling air flow is drawn through the at least one cooling air intake opening and directed toward the at least one cooling air discharge opening facilitated by a pressure differential of the differential pressure passage system.

2. Light source device in accordance with claim 1, wherein at least one air injection opening has a discharge direction which is aligned in a direction toward the hermetically sealed portion facing the front opening of the discharge lamp so as to provide said directional accuracy.

3. Light source device as claimed in claim 1, wherein at least one air injection opening has a discharge direction which is aligned in a direction aimed directly toward at least one selected area of a mirror surface of the concave reflector to provide said directional accuracy.

4. Light source device as claimed in claim 1, wherein said at least one air injection opening comprises a plurality of openings; wherein at least one of the plurality of injection openings has a discharge direction which is aimed toward a hermetically sealed portion on an end of the discharge lamp directed toward said front opening of the reflector; and wherein at least one other of the plurality of air injection openings is aimed directly at an area of a mirror surface of the concave reflector.

5. Light source device as claimed in claim 1, wherein at least one air injection opening is formed by a gap between the translucent glass and a peripheral edge of the front opening of the concave reflector.

6. Light source device as claimed in claim 1, wherein at least one air discharge opening is provided with a sound attenuation tube.

7. Light source device as claimed in claim 6, wherein at least one air injection opening is provided with a sound attenuation tube.

8. Light source device as claimed in claim 1, wherein at least one air injection opening is provided with a sound attenuation tube.

9. Light source device as claimed in claim 1, wherein a sleeve is attached in the neck of the concave reflector, a ventilation path being formed in the sleeve by a series of narrow spaces.

10. Light source device as claimed in claim 1, wherein the front opening of the concave reflector has a maximum opening diameter of at most 80 mm.

11. Light source device as claimed in claim 1, wherein the discharge lamp has a nominal operating wattage of at least 130 W.

12. Light source device in accordance with claim 1, wherein said differential pressure passage system further comprises an air intake fan on an upstream side of said cooling air injection opening and the at least one cooling air discharge opening relative to said cooling air flow and an air exhaust fan on a downstream side of the at least one cooling air injection opening and the at least one cooling air discharge opening relative to said cooling air flow.

13. Light source device in accordance with claim 1, wherein said differential pressure passage system further comprises a housing in which the fans and the discharge lamp are mounted, and a partition separating a first inner space area of the housing containing the air intake fan and the at least one cooling air injection opening from a second inner space area of the housing containing the air exhaust fan and the at least one discharge air injection opening.

14. Light source device in accordance with claim 1, wherein said differential pressure passage system further comprises a housing in which the fans and the discharge lamp are mounted, a first inner space area of the housing containing the air intake fan being connected a second inner space area of the housing containing the air exhaust fan and the at least one discharge air injection opening via a small clearance gap area defined between an inner wall of the housing and a peripheral surface of the reflector surrounding an area at which the front glass is mounted closing the front opening.

* * * * *